US008967792B2

(12) United States Patent
Atwood et al.

(10) Patent No.: US 8,967,792 B2
(45) Date of Patent: Mar. 3, 2015

(54) MOVEABLE PLATEN CART FOR HANDLING SHEETS OF SUBSTRATE MEDIA IN A PRINTING SYSTEM

(71) Applicant: Xerox Corporation, Norwalk, CT (US)

(72) Inventors: Mark A. Atwood, Rush, NY (US); James Joseph Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 20 days.

(21) Appl. No.: 13/708,378

(22) Filed: Dec. 7, 2012

(65) Prior Publication Data

US 2014/0160213 A1 Jun. 12, 2014

(51) Int. Cl.

| | |
|---|---|
| ***B41J 2/01*** | (2006.01) |
| ***B41J 11/00*** | (2006.01) |
| ***B41J 11/06*** | (2006.01) |

(52) U.S. Cl.

CPC ..... *B41J 11/0085* (2013.01); *B41J 11/06* (2013.01)

USPC ..... 347/104; 347/101

(58) Field of Classification Search

CPC ..... B41J 11/02; B41J 11/06; B41J 11/08; B41J 11/10; B41J 11/13; B41J 11/14; B41J 11/0085

See application file for complete search history.

(56) References Cited

U.S. PATENT DOCUMENTS

2010/0195083 A1* 8/2010 Fulwood et al. ..... 355/73

* cited by examiner

*Primary Examiner* — Justin Seo
(74) *Attorney, Agent, or Firm* — Hoffmann & Baron, LLP

(57) ABSTRACT

Disclosed is a moveable platen cart for handling sheets of substrate media in a printing system. The platen cart includes a cart frame, a media platen, a vacuum port and a valve. The cart frame is configured to translate along a process track. The media platen is secured to the cart frame. The media platen has a foraminous upper surface for receiving a substrate media sheet thereon. The media platen has a subsurface cavity in fluid communication with the foraminous upper surface. The vacuum port is for evacuating air from the cavity. The valve is for selectively closing and opening the vacuum port.

20 Claims, 11 Drawing Sheets

MOVEABLE PLATEN CART FOR HANDLING SHEETS OF SUBSTRATE MEDIA IN A PRINTING SYSTEM

TECHNICAL FIELD

The present disclosure relates to an apparatus for and method of holding sheets of substrate media on a moveable platen in a printing system.

BACKGROUND

High speed inkjet marking devices for large sized cut sheets are particularly constrained using contemporary systems with regard to production output, media type and image quality. Systems that handle such large sized cut sheets can use an oversized media platen to support the sheet during the marking process, but placement and registration of the sheet on the platen requires precision. Also, once the sheet is moved into the desired registration position, that position must be reliability maintained. However, such large sheets are particularly difficult to manipulate into and maintain in proper registration upon the platen, particularly if it is a moveable platen.

What is more, providing a vacuum source on a moveable platen adds further problems. A tether or vacuum support line onto a moveable platen limits the configurability of the system. Also, such connections impact motion control and incur additional costs.

Accordingly, it would be desirable to provide an apparatus for and method of retaining substrate media sheets on a platen cart that does not require a tether or fixed line support to maintain a vacuum on a platen cart in order to hold the sheet down and overcomes the various shortcomings of the prior art.

SUMMARY

According to aspects described herein, there is disclosed an a moveable platen cart for handling sheets of substrate media in a printing system. The platen cart includes a cart frame configured to translate along a process track. A media platen is secured to the cart frame, and the media platen has a foraminous upper surface for receiving a substrate media sheet thereon. The media platen has a subsurface cavity in fluid communication with the foraminous upper surface. A vacuum port is provided for evacuating air from the cavity, and a valve is provided for selectively closing and opening the vacuum port.

According to further aspects described herein, there is disclosed an apparatus for conveying sheets of substrate media in a marking device. The apparatus includes a track extending along a process direction, and a moveable platen cart. The cart is configured to translate along the track. The cart has a media platen secured thereto. The media platen has a foraminous upper surface for receiving a substrate media sheet thereon. The media platen has a subsurface chamber in fluid communication with the foraminous upper surface. The cart including a vacuum port for evacuating air from the cavity, and the vacuum port is selectively sealable. The chamber maintains a vacuum when a sheet of substrate media is on the media platen upper surface and the vacuum port is disconnected from a vacuum source.

According to further aspects described herein, there is disclosed an a method of securing a sheet of substrate media on a media platen for handling in a printing system, the method including loading a substrate media sheet onto a media platen located in a loading position, the media platen including a foraminous upper surface for engaging the substrate media sheet; opening a valve to generate a negative flow of air through the foraminous upper surface, the negative flow of air encouraging the substrate media sheet to remain fixed and engaged upon the foraminous upper surface; closing the valve to maintain the negative pressure and retain the media on the platen; and moving the media platen for the loading position with the media retained on the platen by the negative pressure.

DETAILED DESCRIPTION

Figure 1:
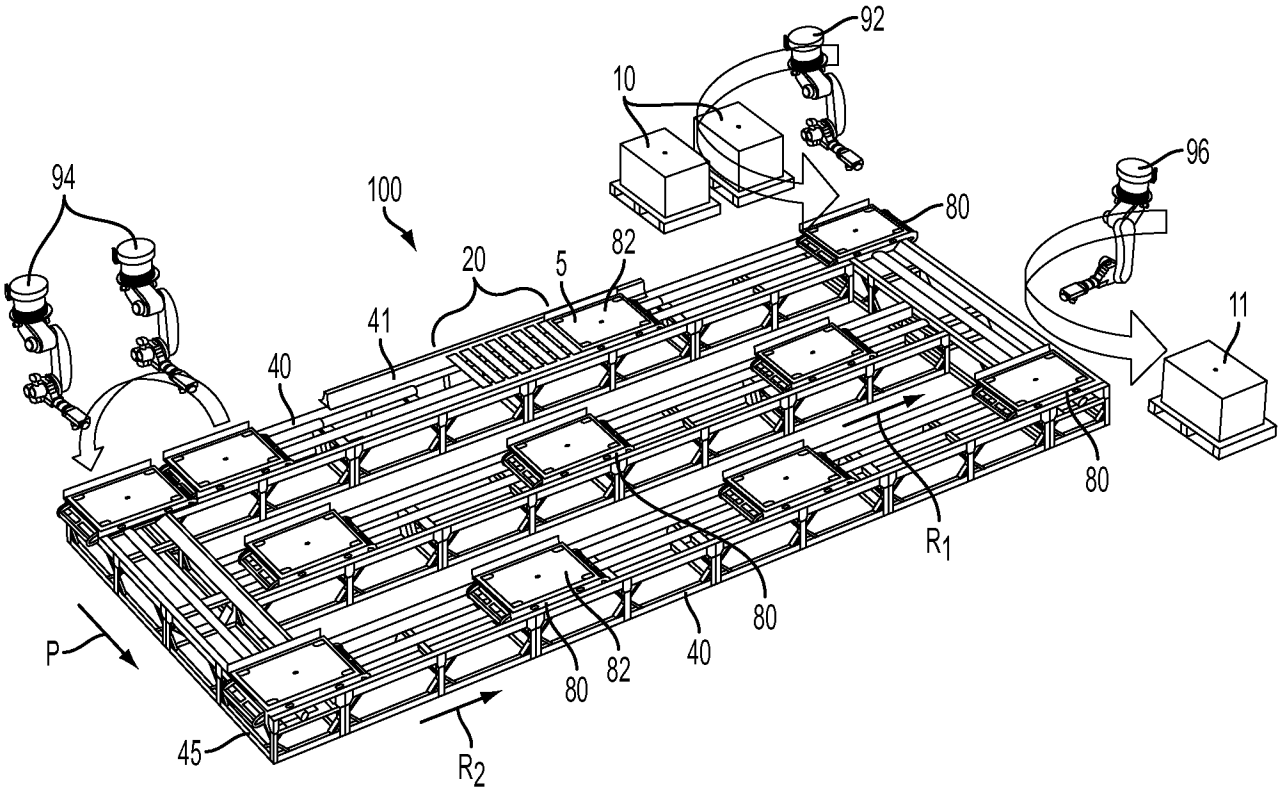
FIG. 1 is a perspective view of an apparatus for handling a sheet of substrate media in a marking assembly in accordance with aspects of the disclosed technologies.

Describing now in further detail these exemplary embodiments with reference to the Figures. The disclosed technologies improve image quality for large format print jobs, while providing an efficient sheet registration and handling system that can improve productivity. The apparatus and methods disclosed herein can be used in a select location or multiple locations of a marking device path that includes a pneumatic table. Thus, only a portion of an exemplary pneumatic table and methods of use thereof are illustrated herein.

As used herein, "substrate media sheet", "substrate media" or "sheet" refers to a substrate onto which an image can be imparted. Such substrates may include, paper, transparencies, parchment, film, fabric, plastic, photo-finishing papers, corrugated board, or other coated or non-coated substrate media upon which information or markings can be visualized and/or reproduced. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in a process direction.

As used herein, "sensor" refers to a device that responds to a physical stimulus and transmits a resulting impulse in the form of a signal for the measurement and/or operation of controls. Such sensors include those that use pressure, light, motion, heat, sound and magnetism. Also, each of such sensors as refers to herein can include one or more sensors for detecting and/or measuring characteristics of a substrate media, such as speed, orientation, process or cross-process position and even the size of the substrate media. Thus, reference herein to a "sensor" can include more than one sensor.

As used herein, "marking zone" refers to the location in a substrate media processing path in which the substrate media is altered by a "marking device." Marking devices as used herein include a printer, a printing assembly or printing system. Such marking devices can use digital copying, bookmaking, folding, stamping, facsimile, multi-function machine, and similar technologies. Particularly those that perform a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, the terms "process" and "process direction" refer to a process of moving, transporting and/or handling a substrate media sheet. The process direction substantially coincides with a direction of a flow path P along which a portion of the media sled moves and/or which the image or substrate media is primarily moved within the media handling assembly. Such a flow path P is said to flow from upstream to downstream. Accordingly, cross-process, lateral and transverse directions refers to movements or directions perpendicular to the process direction and generally along a common planar extent thereof.

As used herein, the term "media platen" refers to a a planar surface for carrying a sheet of substrate media.

As used herein, the term "platen cart" refers to a mobile device or moving a media platen or other planar member. The cart may move along in a guided manner along a track or rail.

As used herein, the term "foraminous surface" refers to a porous surface that allows air to pass there through. The surface may include be porous, perforated or otherwise include numerous holes so that air can pass through.

With reference to FIG. 1, an apparatus 100 for handling a sheet of substrate media in a marking assembly is shown. The sheet handling apparatus 100 is suitable for handling high speed inkjet marking for large size cut sheet paper with flexibility in automation which can improve production output speed and quality and relieve limitations of sheet/image size, media type and image quality. The apparatus 100 includes a modular rail support track 40 designed to convey one or more platen carts 80. The platen carts 80 are moveable along the rail support track 40 conveying a substrate media sheet 5 in a process direction P. The substrate media 5 is held on a sheet platen 82 of the platen cart 80 as the cart moves along one or more portions of the process path, including one or more of the various routes $R_1$, $R_2$ of the rail support track 40. A supply of sheets 10 can be provided such that a loading apparatus 92 loads a sheet onto the platen cart 80 so it can be conveyed towards a marking zone 20 or other sheet marking or handling stations. Two other sheet handling stations that are shown include sheet inverters 94 and an unloading mechanism 96 for removing and collecting process sheets 11 from the apparatus 100.

Within the closed-loop process path defined by the rail support track 40, any number of other stations for application to the substrate media sheets 5 can be provided. For example, additional marking zones can be included, a sheet registration systems, paper cleaning elements, ink curing areas and various other functions that make up a sheet marking system. Considering the modular construction of the rail support track 40, these additional functions/features can be interchangeably added or removed from the apparatus 100 as desired.

As shown, the rail support track 40 includes a series of linear sections. In the illustrative embodiment of FIG. 1, three linear sections run parallel to one another, while a pair of other linear sections extend perpendicular thereto at opposed ends of the three parallel sections. One of those parallel sections in FIG. 1 includes a marking zone 20. The pair of laterally extending track sections 45 at the opposed ends of the three parallel sections can provide a shuttling function for moving the platen cart between desired ones of the three parallel sections. Alternatively, one or both of the laterally extending track sections 45 at the opposed ends can include a marking zone or other media handling assembly, such as a loading/unloading station. The laterally extending track sections 45 can include a supplemental translation cart (not shown). Such a translation cart has an upper portion that resembles and is oriented in the same direction as the parallel rail support track 40. A lower portion of the translation cart is made to convey along the extent of the laterally extending track sections 45. Thus, as the platen cart 80 reaches either one of the laterally extending track sections 45, a translation cart could be positioned to receive it.

Once the platen cart 80 rides onto the upper portion of the translation cart, it should stop so the translation cart can be moved along an extent of the laterally extending track section 45 in order to be conveyed to align with one of the other of the three parallel track sections. In this way, the platen cart 80 need not rotate or turn in order to translate along those laterally extending sections of track. Thus, the translation carts each move back and forth along the extent of one laterally extending track, rather than recirculating around the entire rail support track 40. Generally, the laterally extending track section 45 should each only include a single translation cart. However, if more than one translation cart is used on the same section of laterally extending track 45, then an extension portion (not shown) can be added to the laterally extending track 45. Such an extension portion should extend a short distance beyond one of the outside parallel track sections so that one translation cart can move out of the way of one or more other translation carts on the same section of track.

Ultimately, the rail support track 40 is assembled into a closed-loop, allowing the platen carts 80 to circulate around the track 40. For example, a sheet from the supply 10 can be loaded onto the cart 80 by the loading mechanism 92. Thereafter, the platen cart conveys a sheet 5 along the process direction P through the marking zone 20. Once the cart 80 reaches the shuttle section 45, the cart is conveyed laterally to one of the two routes $R_1$, $R_2$. In this way, the track 40 provides a looping rail system that forms a media path. As used herein, the term "loop" or "closed loop" with regard to the rail support track refers to a path that diverges from, and afterwards returning to, a starting point along the track. The loop can have alternative routes $R_1$, $R_2$, but preferably makes its way back to a common starting position. In this way, a platen cart 80 moving along the track 40 can re-circulate along one or more sections of the track 40.

Figure 2:
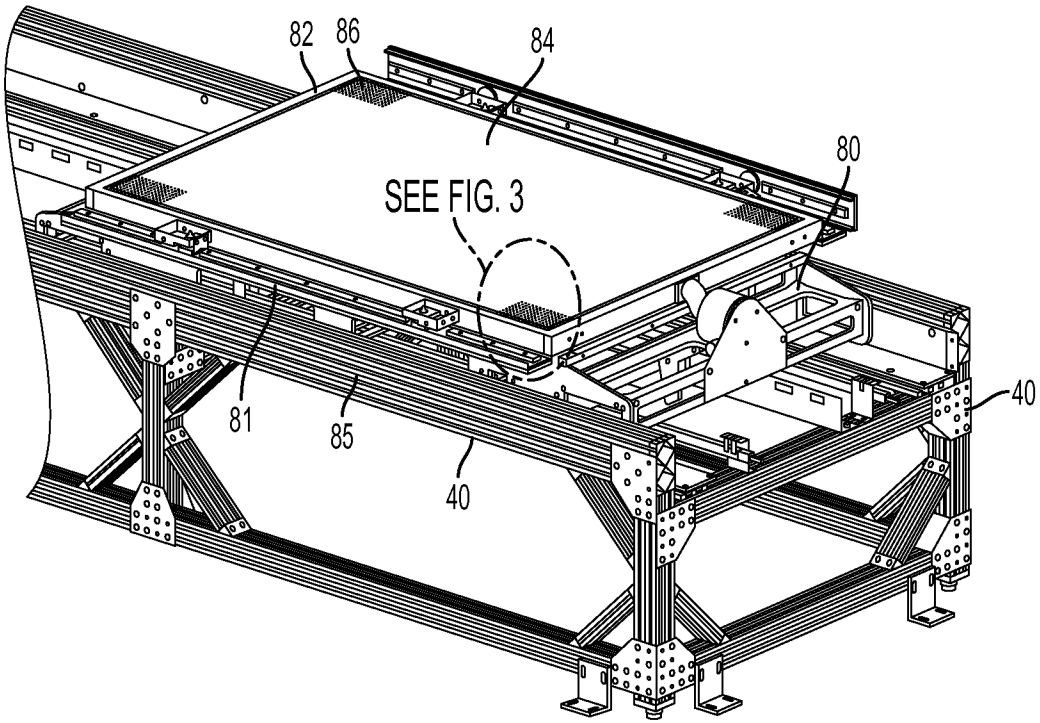
FIG. 2 is a perspective view of a moveable platen cart for handling sheets of substrate media in accordance with aspects of the disclosed technologies.

FIG. 2 shows a perspective view of a moveable platen cart 80 in accordance with aspects of the disclosed technologies. The cart includes a frame 81 configured to translate along the tract. A media platen 82 is supported by and secured to the frame 81. When printing on a sheet, such as a sheet of paper, supported on the media platen 82, precise registration of the sheet must be accomplished before the sheet can be marked or further processed. The media platen 82 is generally formed as a flat rigid plate for supporting the substrate media sheet. Generally the media platen can be a flat metal surface which will support the sheet when pressure is applied thereto, particularly as part of a printing process using marking devices.

The platen cart 80 and methods described herein are particularly useful for handling large size substrate media sheets. In particular, large size paper having dimensions of 62"×42" can be easily accommodated by the disclosed technologies. What is more, larger sheets can be handled as long as the media platen 100 is sized accordingly.

Additionally, it should be understood that the platen cart 80 disclosed herein can be operated in conjunction with a controller (now shown). The controller may also control any number of functions and systems within or associated with the platen cart 80 and accompanying marking systems. The controller may include one or more processors and software capable of generating control signals. Through the coordinated control of the apparatus sub-elements, including a reversible air blower, horizontal biasing elements and sensors, the substrate media sheet may be effectively handled and marked. Further, it should be understood that the controller can also operate related items such as a vacuum source, a sheet loader for initially placing the substrate media sheet onto the platen cart 80.

In accordance with a further aspect of the disclosed technologies, the media platen 82 has an upper surface that includes foraminous portions 84. The foraminous portions can be porous, perforated or otherwise include numerous holes so that air can be pulled through the foraminous upper surface. In the illustrated embodiment, the foraminous upper surface 86 is shown in the four corners of the media platen 82.

Figure 3:
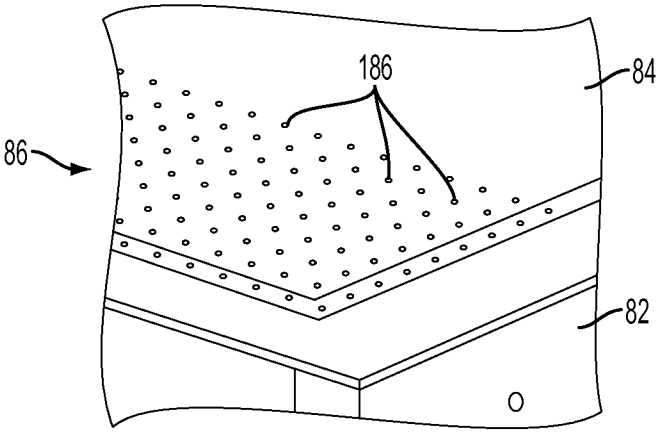
FIG. 3 is a perspective detail view of the foraminous upper surface of the media platen cart at A-A in FIG. 2 in accordance with aspects of the disclosed technologies.

Once a substrate media sheet is placed on the platen upper surface 84 and positioned in proper registration, a vacuum force will be generated for holding down a loaded sheet of substrate media. The substrate media sheet preferably covers the foraminous upper surface portions, thus preventing further air from flowing through that surface. By pumping any residual air out of a hollow vacuum chamber 88 within the platen cart, a negative pressure is created which will hold down the sheet. This vacuum force can hold the sheet secure to the platen surface while the platen translates from station to station until the pressure is released. Once the sheet is held on the platen cart it can proceed to a marking station or other handling stations until the sheet needs to be removed. Once the sheet needs to be removed, the negative pressure will be released by opening a valve 61. Once the vacuum hold down force is relieved, the sheet can then be removed from the platen cart and the cycle can be repeated for another sheet loaded thereon. Preferably, the vacuum station is located near the substrate media sheet loading station. FIG. 3 shows a close-up view of the foraminous upper surface portion 86 of the media platen 82. Other portions of the upper surface of the media platen need not comprise a foraminous surface. In the embodiment shown in FIG. 3, the foraminous surface includes discrete apertures 186 which allow air to flow from the top side of the media platen to an internal vacuum chamber.

Figure 4:
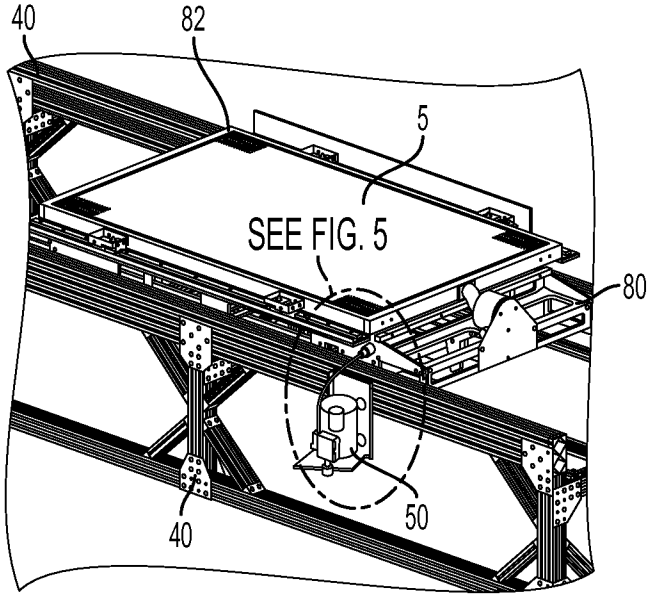
FIG. 4 is a perspective view of a moveable platen cart at a vacuum supply station in accordance with aspects of the disclosed technologies.

FIG. 4 shows the platen cart 80 coupled to a vacuum source 50. As noted above, this station can also be a loading station where the sheet is loaded onto the platen upper surface 84.

Figure 5:
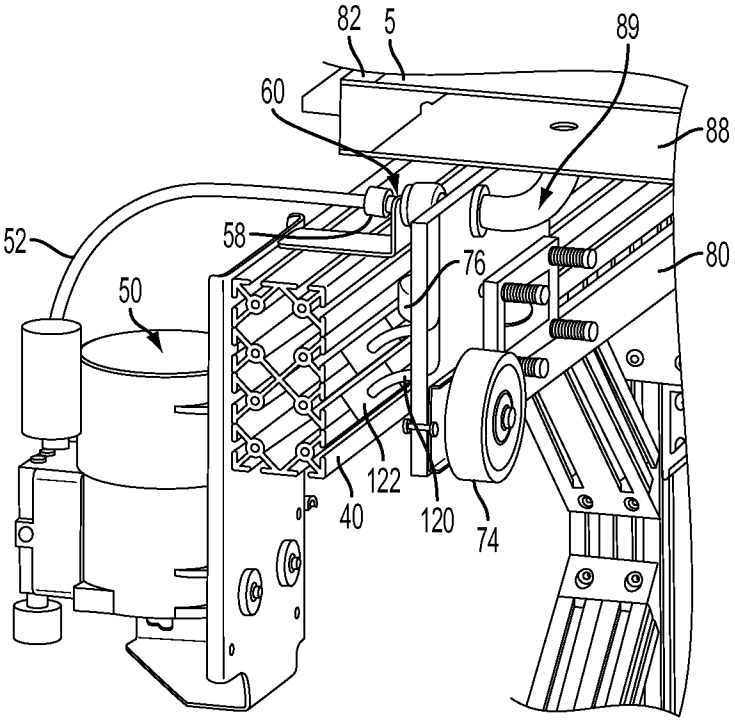
FIG. 5 is a detailed perspective view of the vacuum supply station at B-B in FIG. 4 in accordance with aspects of the disclosed technologies.

FIG. 5 shows a close-up view of the vacuum coupling 60 with the platen cart 80 on the support track 40. Once a connection is made at the vacuum coupling 60 and a sheet covering the foraminous upper surfaces, the vacuum 50 can draw air out of the platen chamber 88. In the embodiment shown, the platen cart 80 includes transport wheels 74, 76 which help the cart translate along the track and maintain lateral position. It should be noted that while the support wheel 74 is shown suspended in mid air, this wheel can be riding along a track surface. In FIG. 5, portions of the support track have been removed in order to more clearly show the vacuum 50 and its support structure. Such support structure includes the vacuum tube 52 connecting the vacuum to the vacuum coupling 60.

Figure 6:
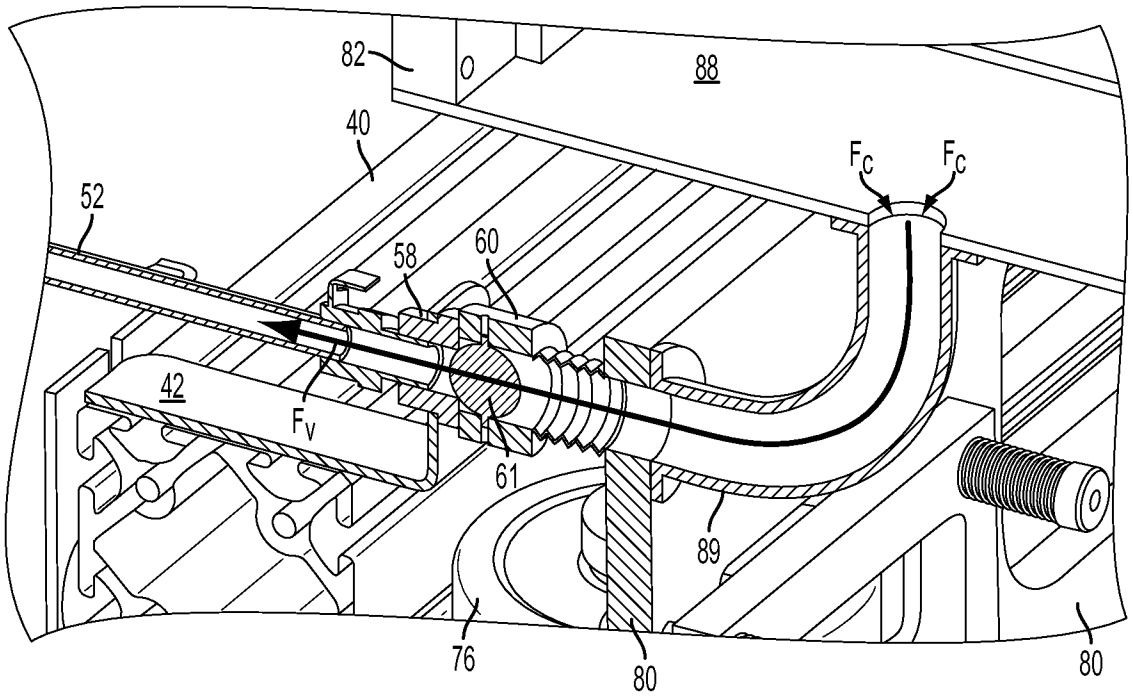
FIG. 6 is a side cross-sectional view of a coupled vacuum port in accordance with aspects of the disclosed technologies showing a valve in the open position.

FIG. 6 shows a cross-sectional view of the vacuum coupling. A portion of the vacuum tubing 52 is shown coming into the docking head 58 which serves to mate with the vacuum port projecting from the platen cart. The vacuum port includes a valve 61 which is shown in an open position. Preferably the valve 61 can be controllably rotated between the open position and a closed position as discussed further below. The valve 61 may be a solenoid controlled valve, such as a 2/2 valve, having an open and closed state. The vacuum port 60 is coupled by tubing 89 to an internal chamber 88 of the media platen 82. In this way, with the vacuum port 60 coupled to the vacuum source, any residual air within the chamber 88 will be drawn out by the negative pressure $F_c$ pulled through the vacuum port and drawn towards the vacuum with a flow $F_v$ towards the vacuum source.

Figure 7:
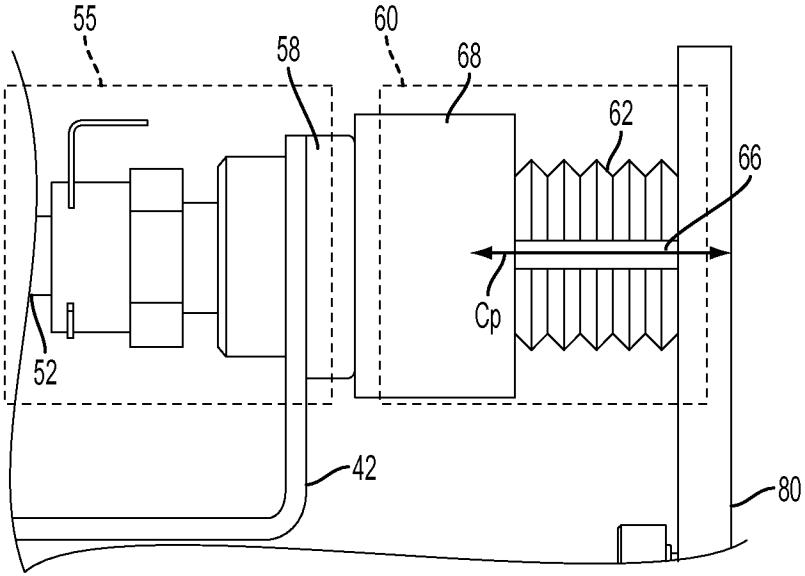
FIG. 7 is a side elevation view of the vacuum port coupling in accordance with aspects of the disclosed technologies.
Figure 8:
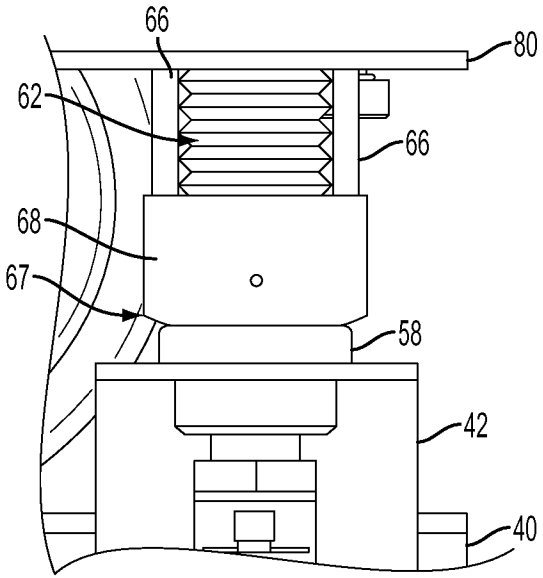
FIG. 8 is a top view of the vacuum port coupling in accordance with aspects of the disclosed technologies.

FIGS. 7 and 8 show a close-up view of the vacuum port coupling. The left and bottom sides of FIGS. 7 and 8 respectively show the stationary elements coupled to the track and vacuum source. Similarly, the right side and top portion of FIGS. 7 and 8 respectively show the vacuum port for evacuating air from the cavity of the media platen. The vacuum source coupling 55 has the vacuum tubing 52 and coupling head 58 supported by a bracket 42. The bracket 42 should be firmly secured to a track 40. Therefore, the vacuum source coupling 55 is stationary.

The platen cart vacuum port 60 operably coupled to the platen cart 80 is brought into coupling engagement with the vacuum port 60 upon the port sliding over and aligning with the coupling head 58 as shown in FIG. 7. Since the platen cart arriving into the coupling zone can have minor variations in its lateral position, the vacuum port 60 is preferably provided with a yielding configuration in order to ensure a sliding union between the parts. This more compliant structure includes a bellows 62 which is flexible and allows the vacuum port head 68 to move in a cross process direction $C_p$ (FIG. 7) at least slightly. As more clearly shown in FIG. 8, the vacuum port head 68 preferably includes beveled lead in edges 67 which can help guide the compliant portion of the platen cart vacuum port 60 attached to the platen cart 80 to mate with the fixed portion of the vacuum source coupling 55 attached to the machine frame 85. More specifically, the beveled edges facilitate vacuum port head 68 sliding over the coupling head 58. The platen cart is controlled to stop at a position wherein the vacuum source coupling 55 is aligned with the vacuum port head 68.

Figure 9:
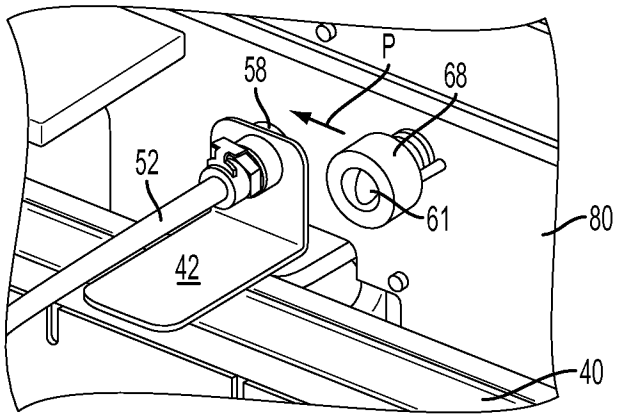
FIG. 9 is a close-up perspective view at B-B of FIG. 4 where the vacuum port is approaching the vacuum source in accordance with aspects of the disclosed technologies.
Figure 10:
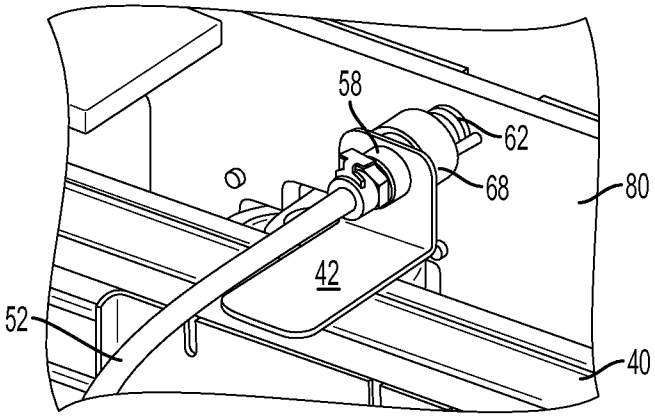
FIG. 10 is a close-up perspective view at B-B of FIG. 4 where the vacuum port is coupled to the vacuum source in accordance with aspects of the disclosed technologies.
Figure 11:
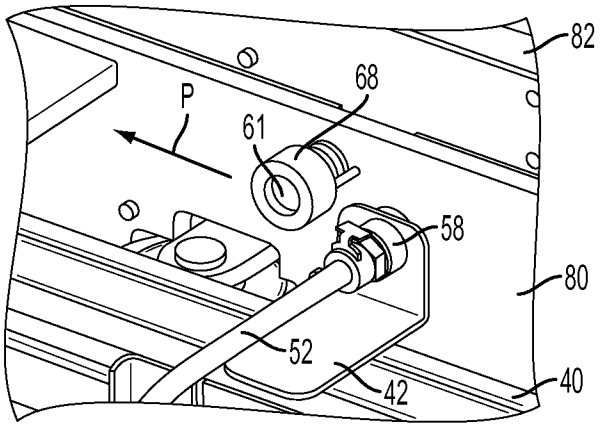
FIG. 11 is a close-up perspective view at B-B of FIG. 4 where the vacuum port is disengaged and moving away from the vacuum source in accordance with aspects of the disclosed technologies.

FIG. 9 shows the platen cart 80 approaching the vacuum source head 58. The valve 61 is shown in the open position as the cart enters the paper loading station. FIG. 10 shows the vacuum port coupled to the vacuum source head 58 and the two portions seated and sealed together. Preferably in this configuration, the valve 61 is made to open so that the vacuum can draw the air out of the internal platen cavity. Once an appropriate level of negative pressure has been created within the platen cavity, the cart can continue along the process path as shown in FIG. 11. It should be noted that at this stage, the valve 61 should be closed in order to maintain the negative pressure within the internal cavity. The valve 61 may be a solenoid controlled valve, such as a 2/2 valve, having a normally closed state. The platen cart 80 is stationary while the sheet 5 is loaded. With further reference to FIG. 5, resilient electrical contacts 120 on the platen cart 80 may engage a set of electrical contacts 122 that are mounted to the machine frame and provide power to the valve/solenoid and move the valve 60 to the open state to allow air to pass there through. Once vacuum has been drawn, the cart 80 is moved on and the electrical contact is broken, thereby causing the valve 60 to assume its normally closed state. With the sheet 5 covering the apertures 186 in the platen and the valve 60 closed, the vacuum in the internal platen cavity 88 is maintained and the sheet 5 is held onto the media platen 100 as the cart 80 advances to the next station.

The above-described moveable platen cart 80 eliminates the requirements for a tether or a vacuum line attached to the moveable platen cart. A moveable platen cart in accordance with aspects of the disclosed technologies can move about freely in a scalable system without limitations to configuration. Also, this system sees cost savings without the need for a power strip, blowers, lengths of hoses and other elements in order to provide a vacuum and maintain a negative pressure in order to hold down the substrate media sheet. The design according to the aspects described herein is scalable and can be implemented for various media types and weights.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A moveable platen cart for handling sheets of substrate media in a printing system, the platen cart comprising:

a cart frame configured to translate along a process track;

a media platen secured to the cart frame, the media platen having a foraminous upper surface for receiving a substrate media sheet thereon, the media platen having a subsurface cavity in fluid communication with the foraminous upper surface;

a vacuum port for evacuating air from the cavity; and a valve for selectively closing and opening the vacuum port.

2. The moveable platen cart as defined in claim 1, wherein the vacuum port includes a mating interface for automatically coupling to a vacuum source.

3. The moveable platen cart as defined in claim 2, wherein the vacuum source is fixedly secured to a track along which the platen cart translates.

4. The moveable platen cart as defined in claim 2, wherein the valve is disposed on the cart frame and opens when the mating interface is coupled to the vacuum source.

5. The moveable platen cart as defined in claim 2, wherein the valve is closed at least when the mating interface is not coupled to the vacuum source.

6. The moveable platen cart as defined in claim 1, wherein the valve is configured to open for releasing the substrate media sheet.

7. The moveable platen cart as defined in claim 1, wherein the media platen is large enough to fully support a substrate media sheet having dimensions of at least 40 inches by 60 inches.

8. The moveable platen cart as defined in claim 2, wherein the vacuum port includes a flexible member to permit movement in a cross-process direction, the flexible member accommodating variations is positing between the vacuum port and the vacuum source.

9. The moveable platen cart as defined in claim 2, wherein the media platen includes a hollow vacuum chamber therein, the chamber being bounded by the foraminous upper surface and being in fluid communication with the vacuum port.

10. An apparatus for conveying sheets of substrate media in a marking device, the apparatus comprising:

a track extending along a process direction; and a moveable platen cart, the cart configured to translate along the track, the cart having a media platen secured thereto, the media platen having a foraminous upper surface for receiving a substrate media sheet thereon, the media platen having a subsurface chamber in fluid communication with the foraminous upper surface, the cart including a vacuum port for evacuating air from the chamber, the vacuum port being selectively sealable, wherein the chamber maintains a vacuum when a sheet of substrate media is on the media platen upper surface and the vacuum port is disconnected from a vacuum source.

11. The apparatus of claim 10, wherein the vacuum source is secured to the track and includes a mating interface for automatically coupling the moveable platen to the vacuum source.

12. The apparatus of claim 11, wherein the valve opens when the mating interface is coupled to the vacuum source to bring the chamber into fluid communication with the vacuum.

13. The apparatus of claim 11, wherein the valve closes at least when the mating interface is not coupled to the vacuum source.

14. The apparatus of claim 10, wherein the valve is configured to open to release vacuum in the chamber wherein the substrate media sheet is released from the platen.

15. The apparatus of claim 10, wherein the media platen is large enough to fully support a substrate media sheet having dimensions of at least 40 inches by 60 inches.

16. The apparatus of claim 10, wherein the vacuum source includes a coupling head and the coupling head is brought into coupling engagement with the vacuum port upon the port sliding over and aligning with the coupling head.

17. A method of securing a sheet of substrate media on a media platen for handling in a printing system, the method comprising:

translating a cart frame, having secured thereto a media platen, along a process track to a loading position;

loading a substrate media sheet onto the media platen when the cart frame is located in a the loading position, the media platen including a foraminous upper surface for engaging the substrate media sheet, the media platen having a subsurface cavity in fluid communication with the foraminous upper surface, the cavity being in fluid communication with a vacuum port;

opening a valve in fluid communication with the vacuum port to generate a negative flow of air through the foraminous upper surface, the negative flow of air encouraging the substrate media sheet to remain fixed and engaged upon the foraminous upper surface;

closing the valve to maintain the negative pressure and retain the media on the platen; and moving the media platen from the loading position with the media retained on the platen by the negative pressure.

18. The method of claim 17, wherein the valve disposed on media platen.

19. The method of claim 17, including moving the media platen to a marking station, and imparting an image to the media wherein the negative pressure is present to retain the media on the media platen.

20. The method of claim 19, including opening the valve to release the negative pressure, and removing the sheet from the platen.

* * * * *